US005183172A

United States Patent [19]

Boller

[11] Patent Number: 5,183,172

[45] Date of Patent: Feb. 2, 1993

[54] DRINK THROUGH CONTAINER LID

[75] Inventor: Peter K. Boller, Willowdale, Canada

[73] Assignee: Lily Cups, Inc., Scarborough, Canada

[21] Appl. No.: 855,823

[22] Filed: Mar. 23, 1992

[51] Int. Cl.[5] ..... B65D 17/34

[52] U.S. Cl. ..... 220/270; 220/711; 220/712; 220/254

[58] Field of Search ..... 220/712, 711, 269, 270, 220/306, 254

[56] References Cited

U.S. PATENT DOCUMENTS

| | | | |
|---|---|---|---|
| 3,977,559 | 8/1976 | Lombardi . | |
| 3,994,411 | 11/1976 | Elfelt et al. . | |
| 4,210,272 | 7/1980 | Sequin | 220/712 X |
| 4,322,015 | 3/1982 | Bailey . | |
| 4,473,167 | 9/1984 | Bailey . | |
| 4,629,088 | 12/1986 | Durgin . | |
| 4,703,857 | 11/1987 | Jahnen et al. | 220/306 X |
| 4,966,294 | 10/1990 | Mack et al. | 220/355 X |
| 5,069,345 | 12/1991 | Irwin | 220/270 |

FOREIGN PATENT DOCUMENTS 1236426 5/1988 Canada .

*Primary Examiner*—Allan N. Shoap

*Assistant Examiner*—Paul Schwarz

*Attorney, Agent, or Firm*—Trevor C. Klotz

[57] ABSTRACT

A drink through container lid of the type formed from thin thermoplastic material and which is used as a closure cap on open mouthed beverage cups is disclosed. Conventional lids of the foregoing description include one or more lines of weakness in the main body portion of the lid and which in part define the drink through segment of the lid. Normal breakage of this segment is initiated by hand at a location on the bottom of the skirt, which may or may not also include a lift tab projecting outwardly from the bottom of the skirt. In accordance with this invention, the lift tab is positioned above the bottom of the remainder of the skirt, and proximate to that portion of the outer wall of the groove of the lid which is in frictional engagement with the beverage cup to which it is attached. By locating the lift tab close to the area of frictional engagement of the lid to the cup, less force is required to initiate fracturing of the thermoplastic material in this area, and reduces the likelihood of the entire lid becoming separated from the container to which it is attached when only separation of the removable segment is desired. Means for further promoting the fracturing of the material can also be located at opposite ends of the lift tab.

8 Claims, 1 Drawing Sheet

DRINK THROUGH CONTAINER LID

FIELD OF INVENTION

This invention relates to lid of thin thermoplastic material used as a cap closure for open mouth beverage cups which have a circular cup rim thereabout, and which also include a removable or flip up segment so as to provide a "drink through" opening therein. More particularly this invention is directed towards lids of the foregoing description which have lift tab means for separating the removable or hinged flip up segment from the lid remainder, but which requires less force to initiate the separation of the segment from the remainder of the lid.

As is known in the art, there are two basic methods for blanking a thermo-formed web which contains the formed lids that appear as multiple repeating lid geometry thereon, and which are supplied to a blanking press containing a multiplicity of punch and die tooling. In one conventional method, a punch and die arrangement is employed in order to cut the lid in a complete circle at the formed web line located at the formed skirt lower extension. When cut or punched, the bottommost skirt portion of the lid, so cut, lies in the lid trim flange plane of the lid. In a second blanking technique, the circular cut is located at the same position, with the added incorporation of a projecting lift tab that extends radially outwardly of the bottommost portion of the skirt and thus is also located in the lid trim flange plane.

The lift tab enables a user to focus on a specific location of the trim flange circumference, which is in opposed relationship to the removable or hinged segment of the lid, so as to facilitate initial breaking of the thermoplastic material at both ends of the lift tab in a direction towards the removable or hinged flip up segment located in the generally circular main body portion of the lid.

It has been well recognized in the art that the hand force applied as a lifting action to either the lift tab, if there is one, or to the trim line circumference of the lid, for the purpose of breaking or cracking the thermoplastic material and which is necessary for segment separation, must be sufficient to overcome the inherent strength of the plastic material. Accordingly, one important consideration in the design of lids as herein described, is the friction fit conformance of the lid to the beverage containment vessel, which must be designed to resist the unwanted lifting off of the entire lid during this hand action.

Another important consideration in lid design is to minimize, to the greatest extent possible, the material's resistance to fracture at the time the separation of the drink through segment is broken away from the lid remainder.

One design option, commonly employed in the art, is to incorporate a "V" notch or slit in the circumferential trim line and thus in the lid trim flange plane just at the tangent point of the junction of the root ends of the lift tab with the adjacent circular trim line, so that a predisposed point of weakness is located at the tear initiation points on either side of the lift tab. This type of arrangement is seen, for example, in U.S. Pat. Nos. 4,322,015 issued Mar. 30, 1982 - Bailey; 4,473,167 issued Sep. 25, 1984 - Bailey; 4,629,088 issued Dec. 16, 1986 - Durgin; 3,977,559 issued Aug. 31, 1976 - Lombardi; and 3,994,411 issued Nov. 30, 1976 -Elfeit. From a production standpoint, this form of lid design has disadvantages in the punch and die construction, as considerable sensitivity of punch and die alignment is required during production set up, and ongoing precision maintenance is needed during lid blanking operations.

A more recent approach in providing predisposed points or initiation sites of material weakness that is desirable for the purpose of creating initial tear or fracture sites is disclosed in Canadian Patent 1,236,426 issued May 10, 1988 - Boller et al, wherein, in a non-tab lid, notches or slits are formed in and extended upwardly from the bottommost portion of the lid skirt, to provide fracture sites in the circumference of the trim line of the circular lid without modification to the circular punch and die assembly.

Whether or not the "V" notches or slits are used as preselected fracture initiation sites for segment removal, from the prior art teachings referred to above, it will be apparent that these notches or slits either extend radially inwardly of or upwardly from the lid trim flange plane, and which corresponds to the plane defined by the bottommost portion of the lid skirt.

Characteristically, in these known types of lid construction that do have fracture initiation sites located in the lid trim flange plane, and which may or may not be used in conjunction with a lift tab located in the same plane, all have the fracture initiation sites positioned at a location which is distanced below that portion of the lid which is in friction fit engagement with the beverage containment vessel or cup.

Consequently, in these known lids that have fracture initiation sites located in the area of the lid trim flange plane, the inherent strength of the material which must be overcome to achieve fracturing is, in part, a function of the strength of the material itself, and, in part, a function of the distance between the initiation sites proximate the skirt bottom and that upper portion of the lid which is in friction fit engagement with the beverage cup to which it is attached.

A further drawback characteristic of lids having break out segments of the foregoing description is the sharp or rough edges created at the fracture initiation sites when the segment is broken away therefrom. These exposed rough edges, which are created when the segment is removed, produce an unwanted sharp or rough "lip feel" when the beverage is sipped through the segment opening of the lid.

SUMMARY OF INVENTION

The novel lid of this invention, which is intended for use as a closure cap on an open mouthed beverage cup, and which also has a removable or flip-back drink through segment therein, comprises a generally circular main body portion, at least one predetermined line of weakness in a selected area of the main body portion so as to provide a break-away segment therein, and a groove disposed about the periphery of the main body portion. The groove is defined in part by an outer wall that is capable of frictionally engaging an exterior wall of the cup adjacent the cup rim when the lid is used as a closure cap thereon. A circular skirt depends downwardly and outwardly from the outer wall of the groove and is further characterized by being interrupted, in an area opposed the break away segment, by a lift tab which itself extends radially outwardly therefrom, and which is located at a position closer to the groove than to the bottom edge of the remainder of the skirt. In other words, and unlike beverage lids as known in the prior art, the location of the lift tab, in accordance with this invention, lies in a plane above the lid trim flange plane.

Preferably, the tab projection is located just below an inwardly projecting rib of the outer wall of the groove and which effectively constitutes the smallest diameter of the lid between the outer wall of the groove and the skirt bottom, and which serves to frictionally engage the lid to a cup. By so positioning the lift tab projection as described, the force required to tear or fracture the material in the skirt for propagation to the line or lines of weakness in the main body portion, is considerably shortened. By way of example, it has been found that a reduction of approximately 30% in the tear distance of the formed plastic below the rib in the outer wall of the groove, results in a more stable frictional engagement of the lid to the cup during the fracturing or tearing motion, thereby reducing the tendency of the lid to be lifted off the container rim concurrently with the lid segment that it is desired to separately remove.

As is known in the art, the rib on the outer wall of the groove and which is directed inwardly to thereby provide frictional engagement of the lid with the exterior wall of a beverage cup to which it is attached, can be either a continuous or discontinuous rib which extends around the outer wall.

Advantageously, fracture initiation means, typically in the form of a pair of spaced apart "V" notches or slits, can be provided in the skirt at opposite ends of the lift tab which itself is located above the lid trim flange plane of the skirt remainder, for the purpose of promoting fracturing of the material in the outer wall when the tab is moved in a direction upwardly away from the cup to which it is frictionally attached. In this preferred form of lid construction, not only is the lift tab located closer to the rib which frictionally engages the outer wall of the beverage cup then that hitherto considered possible, but so too are the fracture initiation means.

Because the location of the lift tab is disposed above the lower portion of the remainder of the skirt, the skirt at its two ends separated by the lift tab can both be curved upwardly towards the lift tab. By so doing, the sharp or rough edges normally created when fracturing is initiated in the bottommost area of the depending skirt is obviated, and the user, when drinking through the break-away segment, experiences less harsh lip feel in this area.

Although a single predetermined line of weakness such as a "C" shaped line of weakness can be formed in a selected area of the main body portion to provide a break-away segment therein, in one preferred form of construction utilized in combination with the novel location of the lift tab and optionally the fracture initiation sites as above described, the break-away segment can, if desired, be delineated by two spaced apart lines of weakness. These lines each extend in a direction inwardly from the groove on the main body portion, with the outermost ends of the lines of weakness being respectively in line with the slits to thereby, further promote fracturing from each fracture initiation site directly towards the opposed outer end of each fracture line.

Optionally and advantageously, in order to provide a flip up break-away segment, a hinge line which traverses the innermost ends of the two straight lines of weakness can be formed into the main body portion of the lid, and if desired, co-operating attachment means can be provided on the main body portion and on the break-away segment for holding the break-away segment and the main body portion together, when the break-away segment and its accompanying lift tab is pivoted at the hinge line over the main body portion. In this flip up arrangement, the segment which is broken away can be hingedly held over the remainder of the main body portion for drink through purposes, and if desired, can be re-closed by flipping back the flip up segment so that it again frictionally engages the exterior wall of the cup.

In the accompanying drawings which illustrate one working embodiment of my invention:

LIST OF DRAWINGS

Figure 1:
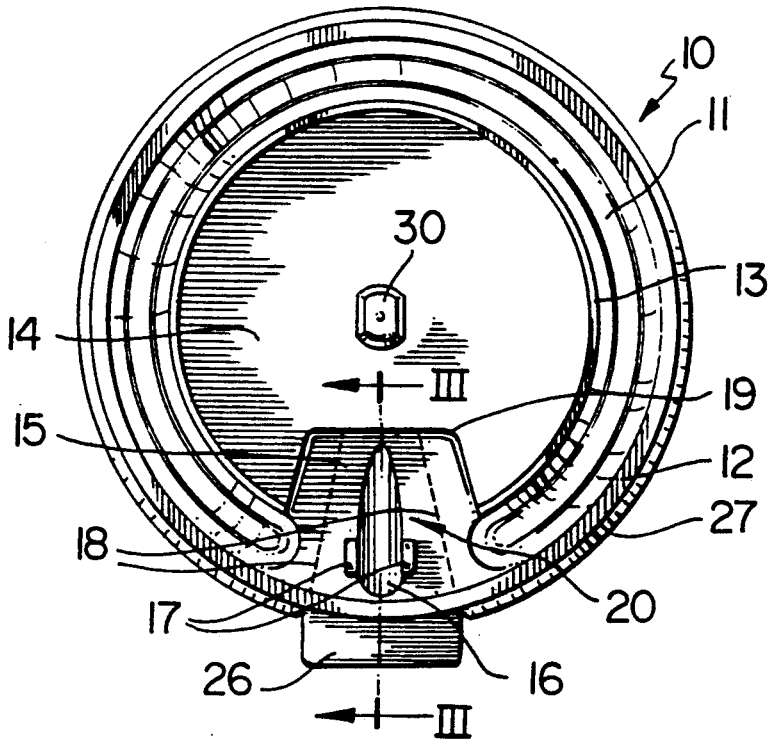
FIG. 1 is a top plan view of a thermoplastic lid which has a flip up segment formed therein.
Figure 3:
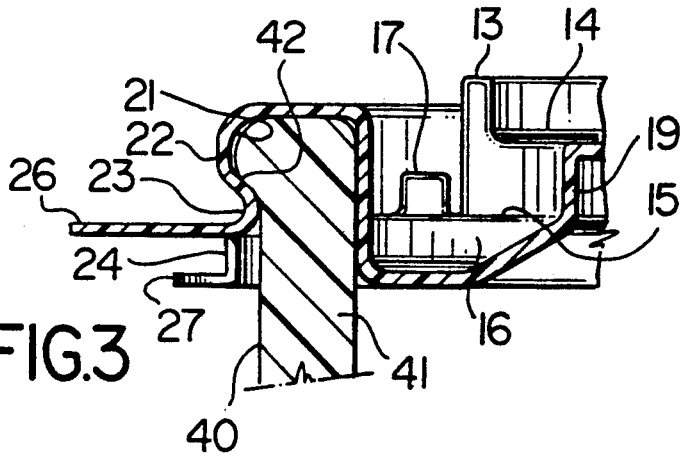

FIG. 3 on an enlarged scale, is a cross-sectional view taken along the lines III—III of FIG. 1 and which also illustrates, in cross section, its frictional engagement to an outer wall of an open mouthed container cup.

DESCRIPTION OF PREFERRED EMBODIMENT

Throughout the drawings, and where possible, like reference numerals have been used to denote the same parts.

The formed thermoplastic lid 10 is made up as a single unit from any thermoplastic material such as, for example, polystyrene. Lid 10 as an integral unit is composed of a generally circular main body portion 11 which, as illustrated, includes an outer "C" shaped recessed portion 12, a raised "C" shaped reinforcing rib 13 and a central panel portion 14. Also forming part of the generally circular main body portion 11 is recessed area 15 which itself includes a tear drop shaped recess or depression 16 with a pair of formed projections 17 on either side thereof as best illustrated in FIG. 1. Recessed area 15 also includes a pair of spaced apart straight lines of weakness 18 so as to provide a break-away segment therein as is well-known in the art. As discussed in greater detail below, the innermost wall 19 of recess 15 traverses the innermost ends of straight lines 18 and thus functions as a hinge joint when segment 20 delineated on its sides by lines of weakness 18, is lifted upwardly relative to the lid remainder.

An annular groove 21 is disposed about the periphery of the main body portion 11 and is best illustrated in FIG. 3. This groove is defined, in part, by an outer wall 22 that is capable of frictionally engaging an exterior wall 40 of a beverage cup 41 adjacent its rim 42.

Outer wall 22 includes rib 23 which is directed inwardly to thereby provide frictional engagement with exterior wall 40 of cup 41. A circular skirt 24 best seen in FIGS. 2 and 3 depends downwardly from outer wall 22 and in a direction outwardly from groove 21.

Figure 2:
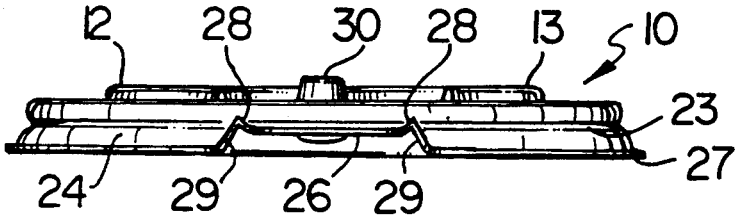
FIG. 2 is a side edge view of the lid of FIG. 1.

As seen with reference to FIGS. 1 and 2, the skirt, 24, in an area opposed break-away segment 20, is interrupted by lift tab 26 which extends radially outwardly therefrom and which is located at a position closer to groove 20 and its attendant rib 23, then to the bottom edge 27 of the remainder of the skirt.

Fracture initiation means in the form of a pair of slits 28 (FIG. 2) are formed in the skirt at opposite ends of lift tab 26, and are used for promoting fracturing of the material in the outer wall 22 located thereabove when the tab is moved in a direction upwardly away from the cup wall 41. As also illustrated in FIG. 2, bottom 27 of skirt 24, at its interruption ends proximate the lift tab 26 are curved upwardly at 29 towards the ends of the lift tab, and are substantially in alignment with slits 28 located at the ends of the lift tab.

Break-away segment 20 and its associated tab 26 as illustrated, upon tab movement in a direction upwardly away from cup wall 41 cause fracturing of the material at the fracture site locations 28 in a direction towards weakness lines 18 formed in the main body portion 11 of recess 15, so that the segment which is broken away can be folded back at hinge line 19. If folded back far enough, projections 17 on break-away segment 20, frictionally engage projection 30 which extends upwardly of the main body portion 11 in order to hold it open in this folded back condition in a manner well known in the art (not shown).

By locating the lift tab in a plane above the skirt bottom 27 and by also locating the fracture initiation sites 28 in approximately in the same plane as the lift tab, it will be apparent that the material in the lid to be fractured is less than in a case where the fracture sites are located at the bottom of the skirt and furthermore, are at a location proximate the frictional engagement of the inwardly projecting rib 23 of outer wall 22 with cup rim 42. The location of the tab, which functions as a hand actuated lever, proximate the area of frictional engagement of the lid to the cup, reduces the tendency of the entire lid to be lifted off the container rim concurrently with the segment of the lid that it is desired to separately remove.

While the invention has been described in context of one example it will be obvious that certain modifications can be made without departing from the spirit or scope of the invention.

I claim:

1. A lid of thin thermo-formed plastic material for use as a removable closure cap on an open mouthed beverage cup which has a circular cup rim thereabout, said lid comprising:

(a) a generally circular main body portion;

(b) at least one predetermined line of weakness formed in a selected area of said main body portion providing a break-away segment therein;

(c) a circular groove disposed about the periphery of said main body portion, said groove being defined in part by an outer wall that is capable of frictionally engaging an exterior wall of said cup adjacent said rim when said lid is used as a closure cap thereon;

(d) a circular skirt having a skirt bottom and which extends downwardly from said outer wall and in a direction outwardly from said groove;

(e) said skirt, along one portion of said skirt bottom adjacent said break-away segment, being provided with a lift tab which extends radially outwardly therefrom and which is further characterized by said lift tab being located at a distance closer to said groove than the distance between said lift tab and the bottom of the remaining portion of said skirt bottom.

2. The lid as claimed in claim 1, wherein said outer wall of said groove has a rib directed inwardly thereby providing said frictional engagement with the exterior wall of said cup.

3. The lid as claimed in claim 2, wherein said rib is continuous around said outer wall.

4. The lid as claimed in claim 2, including fracture initiation means in said skirt at opposite ends of said lift tab for promoting fracturing of said material in said outer wall above said means when said tab is moved in a direction upwardly and away from said cup.

5. The lid as claimed in claim 4, wherein said means for promoting fracturing comprises a pair of spaced apart slits in said skirt located immediately adjacent the ends of said lift tab.

6. The lid as claimed in claim 5, wherein the remaining portion of said skirt bottom proximate both ends of said lift tab is upwardly curved towards the ends of said lift tab.

7. The lid as claimed in claim 6, wherein said break-away segment is delineated by two spaced apart straight lines of weakness each extending in a direction inwardly from said groove on said main body portion and wherein the outermost ends of said lines of weakness are respectively in line with said slits.

8. The lid as claimed in claim 7, further including a hinge line formed in said main body portion and which traverses the innermost ends of said two straight line of weakness, and co-operating attachment means on said main body portion and said break-away segment for holding the break-away segment and said main body portion together when said break-away segment and said lift tab is pivoted at said hinge line over said main body portion.

* * * * *